US011884441B2

(12) United States Patent
Melandri et al.

(10) Patent No.: US 11,884,441 B2
(45) Date of Patent: Jan. 30, 2024

(54) PACKAGING MACHINE AND METHOD FOR PRODUCING SEALED PACKAGES

(71) Applicant: TETRA LAVAL HOLDINGS & FINANCE S.A., Pully (CH)

(72) Inventors: Marco Melandri, Bologna (IT); Paolo Bergami, Formigine (IT); Gianluca Pagliani, Modena (IT); Lorenzo Martini, Modena (IT); Stefano Costa, Casalmaggiore (IT); Roberto Panciroli, Reggio Emilia (IT); Claudio Ferrari, Fiorano Modenese (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/439,276

(22) PCT Filed: Apr. 10, 2020

(86) PCT No.: PCT/EP2020/060316
§ 371 (c)(1),
(2) Date: Sep. 14, 2021

(87) PCT Pub. No.: WO2020/212280
PCT Pub. Date: Oct. 22, 2020

(65) Prior Publication Data

US 2022/0194639 A1 Jun. 23, 2022

(30) Foreign Application Priority Data

Apr. 19, 2019 (EP) ..... 19170359

(51) Int. Cl.
*B65B 9/20* (2012.01)
*B65B 9/207* (2012.01)
(Continued)

(52) U.S. Cl.
CPC ..... *B65B 9/2028* (2013.01); *B65B 9/207* (2013.01); *B65B 41/16* (2013.01); *B65B 51/26* (2013.01);
(Continued)

(58) Field of Classification Search
CPC ..... B65B 9/207; B65H 20/24
See application file for complete search history.

(56) References Cited

U.S. PATENT DOCUMENTS 3,940,042 A * 2/1976 Keck ..... B65H 23/042 226/111
4,350,275 A 9/1982 Kuhn
(Continued)

FOREIGN PATENT DOCUMENTS

CH 633230 A5 * 11/1982 ..... B65H 20/24
DE 4031964 A1 * 4/1992 ..... B41F 13/0045
(Continued)

OTHER PUBLICATIONS

Notice of Reasons for Refusal (The First Office Action) dated Dec. 12, 2023, by the Japanese Patent Office in corresponding Japanese patent Application No. 2021-561908, with English Translation (10 pages).

*Primary Examiner* — Stephen F. Gerrity
(74) *Attorney, Agent, or Firm* — BUCHANAN INGERSOLL & ROONEY PC

(57) ABSTRACT

A packaging machine comprises a conveying device for advancing a web along a web advancement path at least to a tube forming station where the web is formed into a tube and for advancing the tube along a tube advancement path, a tube forming and sealing device configured to form and to longitudinally seal the tube, a tensioning device upstream of the tube forming station and configured to control the tension of the tube and a control unit configured to control packaging machine operation. The tensioning device com-
(Continued)

prises a main drive roller rotatable around a main rotation axis and a main drive motor configured to actuate rotation of the main drive roller around the main rotation axis. The control unit is configured to control the main drive motor such that angular speed and/or angular acceleration of the main drive roller is cyclically varied to control the tension of the tube.

14 Claims, 7 Drawing Sheets

(51) Int. Cl.

| | |
|---|---|
| ***B65B 41/16*** | (2006.01) |
| ***B65B 51/26*** | (2006.01) |
| ***B65B 55/04*** | (2006.01) |
| ***B65B 57/02*** | (2006.01) |
| ***B65H 20/24*** | (2006.01) |

(52) U.S. Cl.
CPC ..... *B65B 55/04* (2013.01); *B65B 57/02* (2013.01); *B65H 20/24* (2013.01); *B65H 2404/143* (2013.01); *B65H 2511/112* (2013.01); *B65H 2513/11* (2013.01); *B65H 2553/00* (2013.01)

(56) References Cited

U.S. PATENT DOCUMENTS

| | | | | | |
|---|---|---|---|---|---|
| 4,800,707 | A | | 1/1989 | Rabus | |
| 5,014,498 | A | | 5/1991 | Mcmahon | |
| 5,707,024 | A | * | 1/1998 | Mellquist et al. | B65H 20/24 242/418.1 |
| 2014/0352257 | A1 | | 12/2014 | Voss et al. | |

FOREIGN PATENT DOCUMENTS

| | | | | | |
|---|---|---|---|---|---|
| DE | 102010029359 | A1 | * | 12/2011 | B65B 41/16 |
| EP | 1195322 | A1 | | 4/2002 | |
| GB | 2205308 | A | | 12/1988 | |
| GB | 2249782 | A | * | 5/1992 | B65H 20/32 |
| JP | S63-044401 | A | | 2/1988 | |
| JP | H04-128105 | A | | 4/1992 | |
| JP | H0585521 | A | * | 4/1993 | B31B 19/10 |
| JP | H07304546 | A | * | 11/1995 | B65B 20/34 |
| JP | H11-043248 | A | | 2/1999 | |
| JP | 2002-104308 | A | | 4/2002 | |
| WO | 9410038 | A1 | | 5/1994 | |
| WO | WO-0187749 | A2 | * | 11/2001 | B31B 19/10 |

* cited by examiner

PACKAGING MACHINE AND METHOD FOR PRODUCING SEALED PACKAGES

TECHNICAL FIELD

The present invention relates to a packaging machine for producing sealed packages of a pourable product, in particular a pourable food product.

The present invention also relates to a method for producing sealed packages of a pourable product, in particular a pourable food product.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for liquid or pourable food products known as Tetra Brik Aseptic (registered trademark), which is made by sealing and folding laminated strip packaging material. The packaging material has a multilayer structure comprising a base layer, e.g. of paper, covered on both sides with layers of heat-seal plastic material, e.g. polyethylene. In the case of aseptic packages for long-storage products, such as UHT milk, the packaging material also comprises a layer of oxygen-barrier material (an oxygen-barrier layer), e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, which advance a web of packaging material through a sterilization apparatus for sterilizing the web of packaging material at a sterilization station and to an isolation chamber (a closed and sterile environment) in which the sterilized web of packaging material is maintained and advanced. During advancement of the web of packaging material through the isolation chamber, the web of packaging material is folded and sealed longitudinally at a tube forming station to form a tube having a longitudinal seam portion, the tube being further fed along a vertical advancing direction.

In order to complete the forming operations, the tube is filled with a sterilized or sterile-processed pourable product, in particular a pourable food product, and is transversally sealed and subsequently cut along equally spaced transversal cross sections within a package forming unit of the packaging machine during advancement along the vertical advancing direction.

Pillow packages are so obtained within the packaging machine, each pillow package having a longitudinal sealing band, a top transversal sealing band and a bottom transversal sealing band.

A typical packaging machine comprises a conveying device for advancing the web of packaging material along a web advancement path and a tube formed from the web of packaging material along a tube advancement path, the sterilization apparatus for sterilizing the web of packaging material prior to its formation into the tube, a tube forming and sealing device at least partially arranged within an isolation chamber and being configured to form the tube from the advancing web of packaging material and to longitudinally seal the tube, a filling device for filling the tube with the pourable product and a package forming unit adapted to form, transversally seal and cut the single packages from the tube of packaging material.

A typical packaging machine also comprises a tensioning device configured to control the tension of the tube.

In particular, it is known to arrange the tensioning device between the sterilization station and the tube forming station for controlling the tension of the tube.

A typical tensioning device comprises at least one first roller rotatable around a first rotation axis, one first counter-roller adjacent to the first roller, one second roller rotatable around a second rotation axis and arranged downstream of the first roller, one second counter-roller adjacent to the second roller and a drive motor associated to the second roller for actuating rotation of the second roller around the second rotation axis.

A typical tensioning device further comprises a pendulum roller interposed between the first roller and the second roller and configured to tension the portion of the web of packaging material expanding between the first roller and the second roller.

It should be noted that the operation of the package forming unit is cyclic leading to cyclic forces and variations in the advancement speed of the tube.

Therefore, the tensioning device is controlled such that the drive motor controls a constant rotation speed of the second roller, which corresponds to the average advancement speed of the tube and the operation of the pendulum roller compensates for the difference between the web advancement speed resulting from the rotation of the second roller and the advancement speed of the tube.

The applicant has found out that while the control of the tension of the tube is done sufficiently well allowing for a reliable production of the packages, the tension of the tube partially varies in an uncontrolled manner.

Therefore, the desire is felt to improve the known tension devices and the method of producing packages so as to improve preciseness and/or reliability of the tension control.

DISCLOSURE OF INVENTION

It is therefore an object of the present invention to provide a packaging machine to overcome, in a straightforward manner, at least one of the aforementioned drawbacks.

In particular, it is an object of the present invention to provide a packaging machine coming along with an improved tension control.

It is a further object of the present invention to provide a method for producing sealed packages to overcome, in a straightforward manner, at least one of the aforementioned drawbacks.

In particular, it is an object of the present invention to provide a method coming along with an improved tension control.

According to the present invention, there is provided a packaging machine and a method for producing sealed packages according to the respective independent claims.

Preferred embodiments are claimed in the dependent claims.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
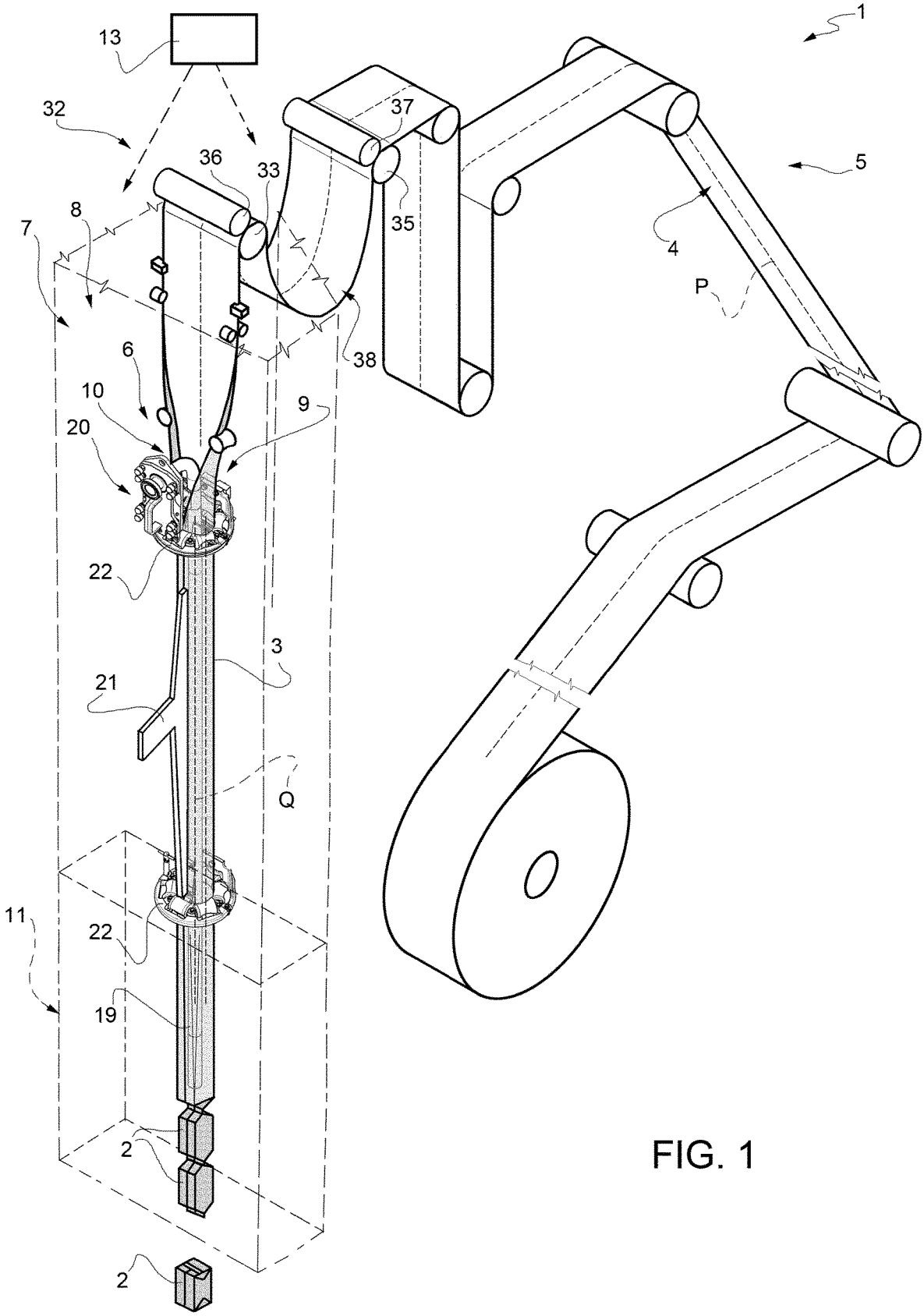
FIG. 1 is a schematic view of a packaging machine according to the present invention, with parts removed for clarity.

Number 1 indicates as a whole a packaging machine for producing sealed packages 2 of a pourable product, in particular a pourable food product such as pasteurized milk, fruit juice, wine, tomato sauce, etc., from a tube 3 of a web 4 of packaging material. In particular, in use, tube 3 extends along a longitudinal axis, preferentially having a vertical orientation.

Web 4 has a multilayer structure (not shown), and comprises at least a layer of fibrous material, such as e.g. a paper or cardboard layer, and at least two layers of heat-seal plastic material, e.g. polyethylene, interposing the layer of fibrous material in between one another. One of these two layers of heat-seal plastic material defines the inner face of package 2 eventually contacting the pourable product.

Preferably but not necessarily, web 4 also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, web 4 also comprises a further layer of heat-seal plastic material being interposed between the layer of gas- and light-barrier material and the layer of fibrous material.

According to a preferred non-limiting embodiment, web 4 comprises a first face and a second face, in particular the first face being the face of web 4 forming the inner face of the formed package 2 eventually contacting the filled pourable food product.

According to a preferred non-limiting embodiment, a typical package 2 obtained by packaging machine 1 comprises a longitudinal seam portion and a pair of transversal sealing bands, in particular a transversal top sealing band and a transversal bottom sealing band.

With particular reference to FIG. 1, packaging machine 1 is configured to advance web 4 along a web advancement path P, preferably to sterilize web 4 during advancement along path P, to form and longitudinally seal tube 3 from web 4, preferably to fill tube 3 with the pourable product and, preferentially to form single packages 2 from the filled tube 3.

Figure 2:
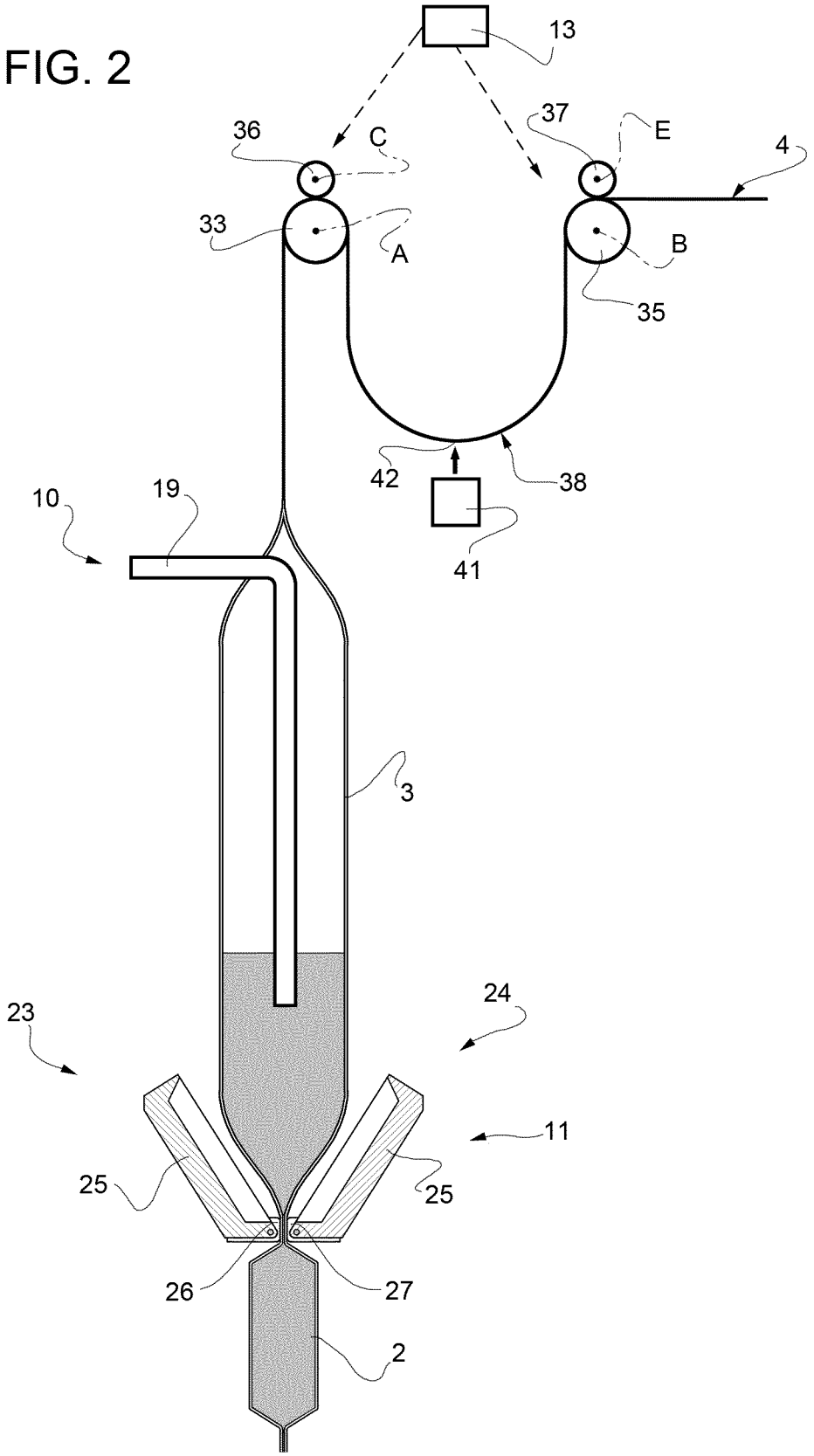
FIG. 2 is a schematic view of portions of the packaging machines of FIG. 1, with parts removed for clarity.

With particular reference to FIGS. 1 and 2, packaging machine 1 comprises:

- a conveying device 5 configured to advance web 4 along a web advancement path P at least to a tube forming station 6 at which web 4 is formed, in use, into tube 3 and for advancing tube 3 along a tube advancement path Q;
- an isolation chamber 7 having an inner (sterile) environment 8 and extending along a longitudinal axis, preferentially but not necessarily the longitudinal axis having a vertical orientation;
- a tube forming and sealing device 9 at least partially arranged within isolation chamber 7 and being configured to form and longitudinally seal tube 3 at tube forming station 6, in particular within at least a portion of isolation chamber 7, even more particular within inner environment 8;
- in particular, a filling device 10 for filling tube 3 with the pourable product; and
- in particular, a package forming unit 11 adapted to (configured to) at least form and transversally seal tube 3, preferentially to also transversally cut tube 3, between successive packages 2, in particular during advancement of tube 3 along tube advancement path Q, for forming packages 2 themselves.

According to a preferred non-limiting embodiment, packaging machine 1 further comprises a sterilization apparatus for sterilizing at least a portion of web 4, preferentially at least the first face, even more preferentially the first face and the second face, in particular at a sterilization station arranged upstream of tube forming station 6 along web advancement path P.

According to a preferred non-limiting embodiment, packaging machine 1 also comprises a control unit 13 for controlling operation of packaging machine 1 itself.

According to a preferred non-limiting embodiment, packaging machine 1 also comprises a magazine unit adapted to host and to provide for web 4 at a host station. In particular, conveying device 5 is configured to advance web 4 from the host station to tube forming station 6.

In particular, package forming unit 11 is arranged downstream of isolation chamber 7 and tube forming and sealing device 9 along path Q.

Preferentially but not necessarily, conveying device 5 is adapted to advance tube 3 and any intermediate of tube 3 in a manner known as such along path Q, in particular from tube forming station 6 through isolation chamber 7, in particular towards and at least partially through package forming unit 11. In particular, with intermediates of tube 3 any configuration of web 4 is meant prior to obtaining the tube structure and after folding of web 4 by tube forming and sealing device 9 has started. In other words, the intermediates of tube 3 are a result of the gradual folding of web 4 so as to obtain tube 3, in particular by overlapping opposite lateral edges of web 4 with one another.

According to a preferred non-limiting embodiment, the sterilization apparatus is configured to sterilize web 4, in particular the first face, even more particular also the second face, by means of physical sterilization such as a sterilization irradiation, in particular an electromagnetic irradiation, even more particular electron beam irradiation.

Alternatively or in addition, the sterilization apparatus could be configured to sterilize web 4, in particular the first face, even more particular also the second face, by means of chemical sterilization, in particular by means of hydrogen peroxide.

According to a preferred non-limiting embodiment, isolation chamber 7 separates inner environment 8 from an outer environment, in particular for allowing to form and to fill tube 3 within a controlled atmosphere. In particular, inner environment 8 contains a sterile gas.

With particular reference to FIGS. 1 and 2, filling device 10 comprises at least a filling pipe 19 being in fluid connection with a pourable product storage tank (not shown and known as such) and partially extending within isolation chamber 7, in particular inner environment 8. In particular, in use, filling pipe 19 is partially placed within tube 3 for feeding the pourable product into the, in use, advancing tube 3.

With particular reference to FIG. 1, tube forming and sealing device 9 comprises at least a tube forming assembly 20 configured to form tube 3 from web 4, in particular by overlapping the respective lateral edges of web 4, and at least a sealing head 21 configured to longitudinally seal tube 3, in particular along the portion of tube 3 obtained by the overlapping of the lateral edges of web 4.

Preferentially but not necessarily, tube forming assembly 20 and sealing head 21 are arranged within isolation chamber 7, in particular within inner environment 8.

Preferentially but not necessarily, tube forming assembly 20 comprises at least a plurality of forming ring assemblies 22, in the particular example shown two, being adapted to fold web 4 gradually into tube 3. In particular, forming ring assemblies 22 are arranged within parallel and spaced apart planes, in particular being orthogonal to the longitudinal axis of isolation chamber 7, even more specifically having a substantially horizontal orientation.

Preferentially but not necessarily, tube forming and sealing device 9 also comprises a pressuring assembly configured to exert a mechanical force on tube 3, in particular for promoting the longitudinal sealing of tube 3. In particular, the pressuring assembly is associated to the forming ring assembly 22 being arranged downstream of the other forming ring assembly 22 along web advancement path P and/or tube advancement path Q.

According to a preferred non-limiting embodiment, package forming unit 11 comprises a plurality of pairs of at least one respective operative assembly 23 (only one shown) and at least one counter-operative assembly 24 (only one shown); and in particular, at least one conveying unit (not shown and known as such) adapted to advance the respective operative assemblies 23 and the respective counter-operative assemblies 24 of the pairs along respective conveying paths.

Preferentially but not necessarily, each operative assembly 23 is adapted to cooperate, in use, with the respective counter-operative assembly 24 of the respective pair for forming a respective package 2 from tube 3. In particular, each operative assembly 23 and the respective counter-operative assembly 24 are configured to form, to transversally seal and, preferably but not necessarily also to transversally cut, tube 3 for forming packages 2, in particular when, in use, advancing along a respective operative portion of the respective conveying path.

Preferentially but not necessarily, each operative assembly 23 and the respective counter-operative assembly 24 are adapted to cooperate with one another for forming a respective package 2 from tube 3 when advancing along a respective operative portion of the respective conveying path.

Preferentially but not necessarily, each operative assembly 23 and the respective counter-operative assembly 24 are configured to contact tube 3 when advancing along the respective operative portion of the respective conveying path, in particular starting to contact tube 3 at a (fixed) hit position.

Preferentially but not necessarily, each operative assembly 23 and counter-operative assembly 24 comprises:

a half-shell 25 adapted to contact tube 3 and to at least partially define the shape of packages 2;

one of a sealing element 26 and a counter-sealing element 27, adapted to transversally seal tube 3 in a known manner between adjacent packages 2; and preferably but not necessarily, one of a cutting element (not shown and known as such) and a counter-cutting element (not shown and known as such) for transversally cutting tube 3 between adjacent packages 2 in a manner known as such.

Preferentially but not necessarily, each half-shell 25 is adapted to be controlled between a working position and a rest position by means of a driving assembly (not shown). In particular, each half-shell 25 is adapted to be controlled into the working position with the respective operative assembly 23 or the respective counter-operative assembly 24, in use, advancing along the respective operative portion.

Preferentially but not necessarily, each sealing element 26 and each counter-sealing element 27 is adapted to be controlled between an active sealing position in which sealing element 26 and counter-sealing element 27 are in contact with tube 3 and are adapted to transversally seal in collaboration tube 3 and a rest position in which sealing element 26 and counter-sealing element 27 are detached from tube 3. In particular, each sealing element 26 and each counter-sealing element 27 is adapted to be controlled into the sealing position with the respective operative assembly 23 or the respective counter-operative assembly 24, in use, advancing along the respective operative portion.

Preferentially but not necessarily, each half-shell 25 is configured to be controlled into the respective working position with the respective sealing element 26 and counter-sealing element 27 being controlled into the respective active position.

Preferentially but not necessarily, each operative assembly 23 and each counter-operative assembly 24 in collaboration with the conveying unit are configured to exert a traction force on tube 3 for advancing tube 3 along tube advancement path Q. As the function of operative assemblies 23 and counter-operative assemblies 24 comes along with varying steps, the traction force is not linear but shows a complex behavior leading to a complex profile of the advancement speed of tube 3, as shown for example in FIGS. 6 and 7.

Preferentially but not necessarily, operative assemblies 23, counter-operative assemblies 24 and the conveying unit can be considered to form part of conveying device 5.

It should be noted that the forces acting on tube 3 and resulting from the interaction with operative assemblies 23 and counter-operative assemblies 24 depend on the varying steps of the formation of packages 2 (the package formation cycle). The forces acting on tube 3 vary e.g. due to the sealing elements 26 and counter-sealing elements 27 contacting tube 3 when being controlled into the respective active positions and/or when half-shells 25 are controlled into the respective working positions and/or the traction of tube 3 due to the advancement of operative assemblies 23 and counter-operative assemblies 24 along the respective conveying paths.

Figure 6:
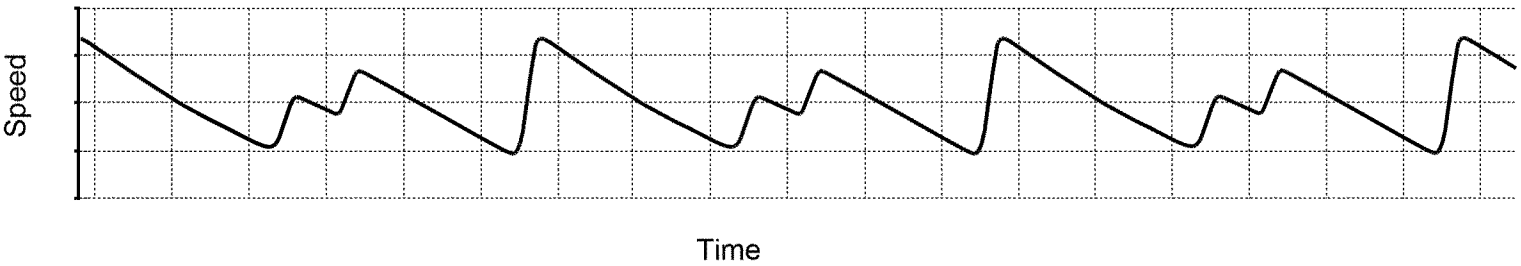
FIG. 6 shows a time-dependent cyclic speed profile of an advancing tube during operation of the packaging machine of FIG. 1.
Figure 7:
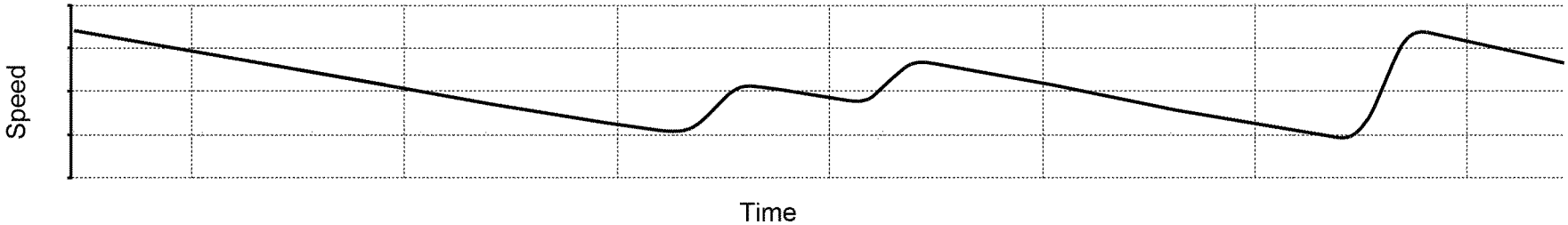
FIG. 7 shows a time-dependent speed profile of the advancing tube during the formation of a single package from the tube.

In particular, the interaction of operative assemblies 23 and counter-operative assemblies 24 with tube 3 also result in a cyclic advancement speed of web 4 (in particular, the portion of web 4 advancing downstream of tensioning device 32 along web advancement path P) and/or tube 3 as shown in FIGS. 6 and 7.

In particular, during the process of the formation of packages 2 (by means of package forming unit 11) a complex and cyclic behavior of the acting forces is present (similar to the cyclic advancement speed shown in FIGS. 6 and 7).

With particular reference to FIGS. 1 and 2, packaging machine 1 also comprises at least one tensioning device 32 configured to control at least the tension of tube 3, in particular in dependence of cyclic advancement speed of web 4 and/or tube 3 and/or in dependence of the operation of package forming unit 11.

In particular, tensioning device 32 is arranged upstream of tube forming station 6 along web advancement path P and is configured to control the tension of tube 3, and in particular of the portion of web 4 extending between tensioning device 32 and tube forming and sealing device 9 and/or tube forming station 6.

Even more particular, tensioning device 32 is arranged upstream of tube forming station 6 and/or tube forming and sealing device 9 and downstream of the sterilization station and/or the sterilization device.

Advantageously, control unit 13 is configured to control operation of tensioning device 32.

With particular reference to FIGS. 1 to 5, tensioning device 32 comprises at least:

- a main drive roller 33 rotatable around a main rotation axis A; and a
- a main drive motor 34, in particular a servo motor, connected to main drive roller 33 and configured to actuate rotation of main drive roller 33 around rotation axis A.

According to a preferred non-limiting embodiment, tensioning device 32 further comprises:

- an auxiliary drive roller 35 rotatable around an auxiliary rotation axis B; and
- an auxiliary drive motor (not shown), in particular an auxiliary servo motor, connected to auxiliary drive roller 35 and configured to actuate and/or control rotation of auxiliary drive roller 35 around rotation axis B.

Figure 3:
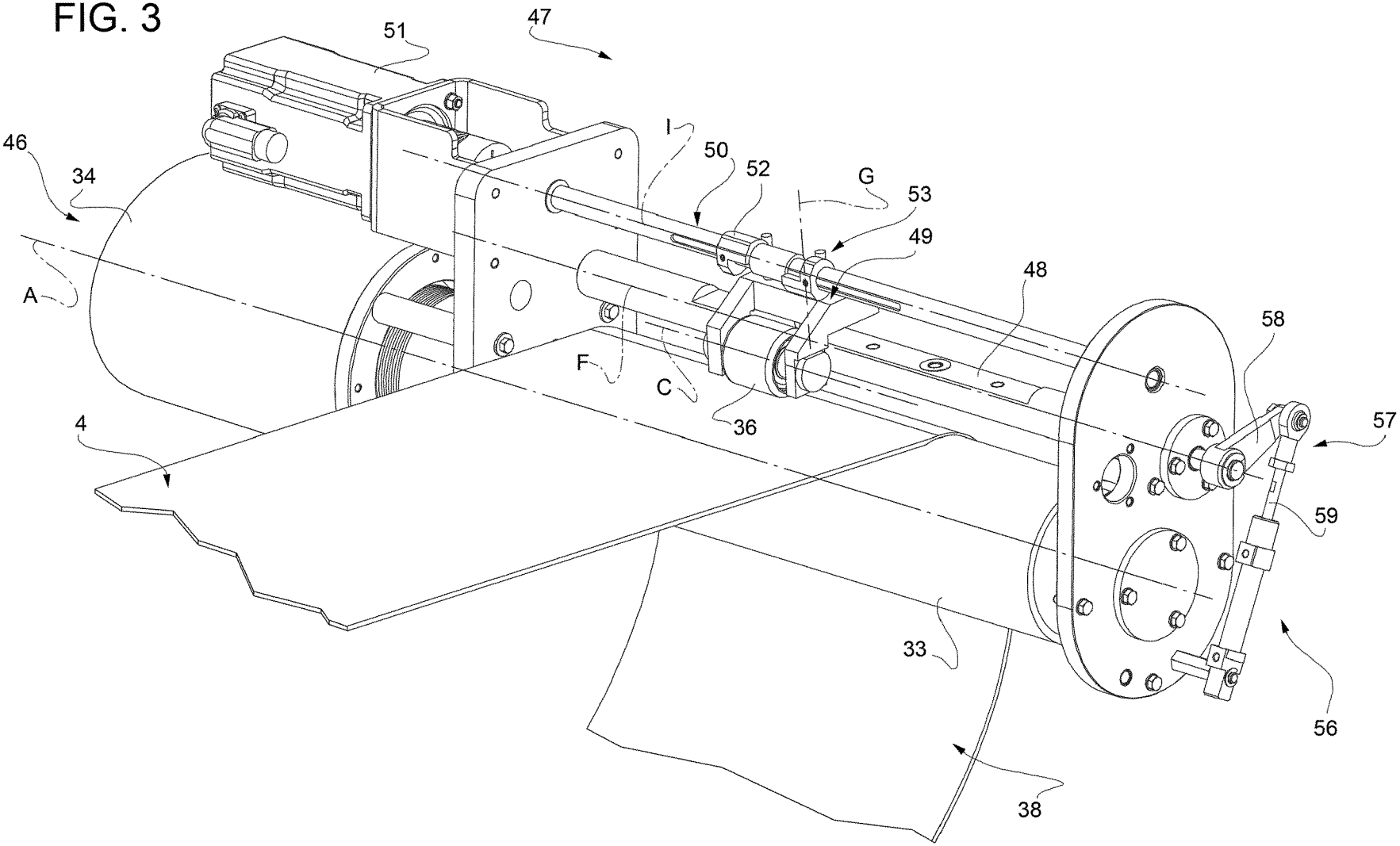
FIG. 3 is a perspective view of a detail of the packaging machine of FIG. 1, with parts removed for clarity.
Figure 5:
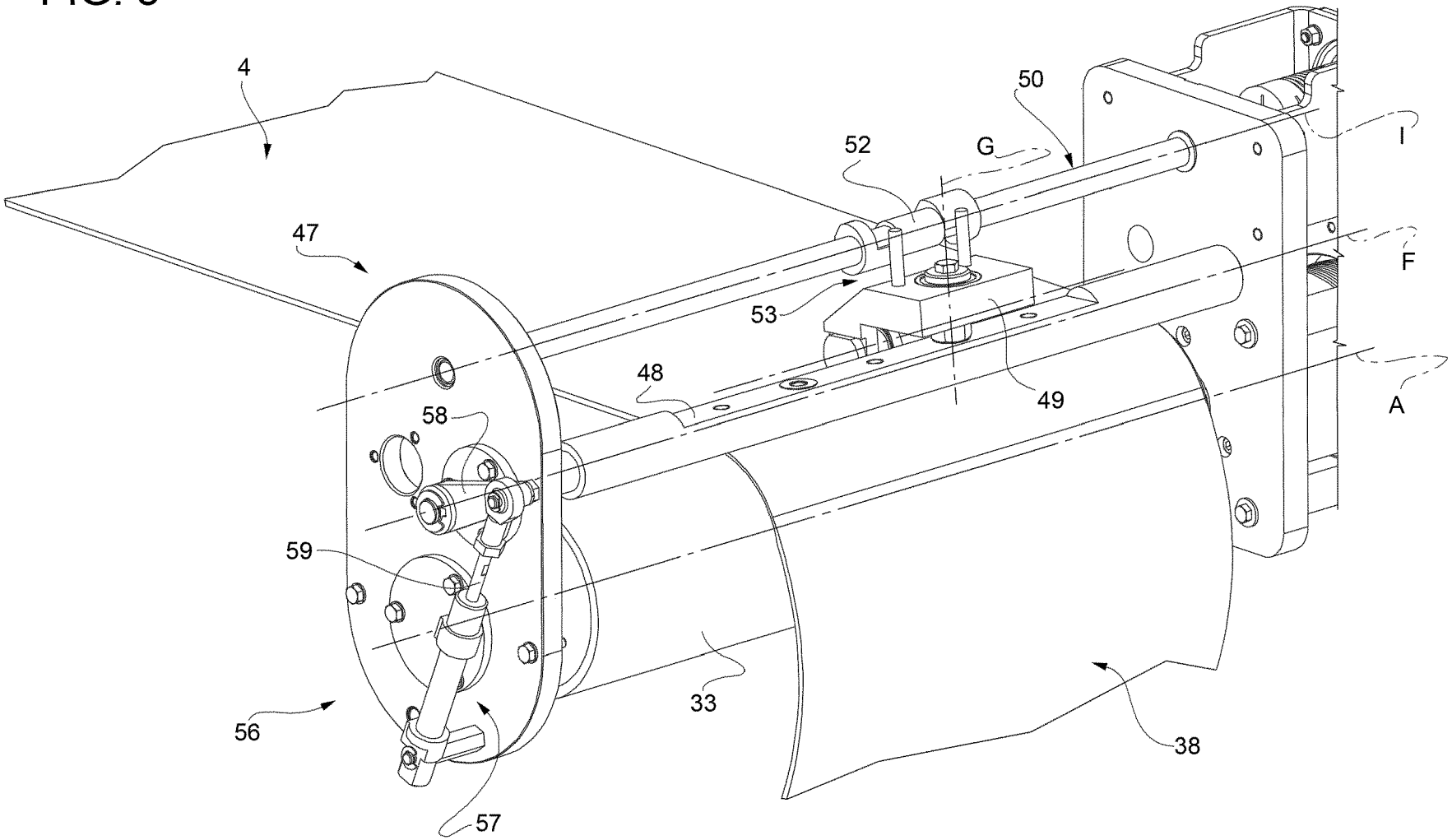
FIG. 5 is a perspective view of the detail of FIG. 3 according to a different perspective, with parts removed for clarity.

It should be noted that FIGS. 3 and 5 illustrate a first portion of tensioning device 32 having main drive roller 33 and main drive motor 34. A second portion of tensioning device 32 having auxiliary drive roller 35 and the respective auxiliary drive motor is not specifically shown, as the second portion is substantially identical to the first portion.

According to a preferred non-limiting embodiment, auxiliary drive roller 35 and the respective main drive roller 33 are spaced apart along web advancement path P, in particular with auxiliary drive roller 35 being arranged upstream of main drive roller 33.

According to a preferred non-limiting embodiment, tensioning device 32 further comprises at least:

- a main counter-roller 36 rotatable around a central axis C and being arranged adjacent, in particular peripherally adjacent, even more particular tangential, to main driver roller 33; and
- in particular an auxiliary counter-roller 37 rotatable around a central axis E and being arranged adjacent, in particular peripherally adjacent, even more particular tangential, to auxiliary drive roller 35.

According to a preferred non-limiting embodiment, and according to the relative arrangement of auxiliary drive roller 35 and main drive roller 33, auxiliary counter-roller 37 is arranged upstream of main counter-roller 36 along web advancement path P.

In particular, in use, web 4 is interposed and/or advances between main counter-roller 36 and main drive roller 33, and in particular between auxiliary counter-roller 37 and auxiliary drive roller 35. In other words, in use, during advancement of web 4, web 4 advances between main drive roller 33 and main counter-roller 36, and in particular between auxiliary drive roller 35 and auxiliary counter-roller 37.

Advantageously, control unit 13 is configured to control main drive motor 34 such that an angular speed of main drive roller 33 is cyclically varied such to control the tension of tube 3, and in particular also of the portion of web 4 extending between main drive roller 33 and tube forming station 6.

In particular, in the context of the present description, the term "cyclically varied" indicates that the angular speed and/or the angular acceleration of main drive roller 33 follows respectively a time-dependent speed profile and/or time-dependent acceleration profile, which repeat(s) according to a defined and/or determined and/or given frequency.

In other words, control unit 13 is configured to control main drive motor 34 such that the angular speed and/or the angular acceleration of main drive roller 33 is cyclically varied according to respectively a time-dependent speed profile and/or acceleration profile, which repeats according to a defined operation frequency.

It should, however, be noted that according to some non-limiting embodiments, the specific speed profile and/or acceleration profile to be repeated may be modified during operation of packaging machine 1, in particular according to a feedback-loop.

Even more particular, the time-dependent speed profile is defined according to a cycle of the production of a package 2 and/or the operation of package forming unit 11.

In particular, controlling the angular speed and/or the angular acceleration of main drive roller 33 around the respective rotation axis A (and the respective main drive motor 34) according to respectively a cyclic speed profile and/or acceleration profile is advantageous as the forces acting on tube 3 during the formation of packages 2 are cyclic.

According to a preferred non-limiting embodiment, control unit 13 is configured to control main drive motor 34 such that the angular speed and/or the angular acceleration of main drive roller 33 is varied and/or controlled as a function of the operation of package forming unit 11 and/or as a function of the package forming cycle and/or the forces acting on tube 3 and/or the operation of filling device 10 and the filling of tube 3.

In particular, the package forming cycle is substantially determined by the interaction of operative assemblies 22 and counter-operative assemblies 23, in particular of the respective half-shells 25, sealing elements 26 and counter-sealing elements 27, with tube 3.

In particular, as mentioned above, the forces acting on tube 3 result from interaction of tube 3 with operative assemblies 23 and counter-operative assemblies 24 and the varying steps of the formation of packages 2, in particular due to the respective sealing elements 26 and counter-sealing elements 27 being controlled into the respective sealing position and/or the respective half-shells 25 being controlled into the working position and/or the advancement of operative assemblies 23 and counter-operative assemblies 24 along the respective operative portions of the conveying paths and/or the introduction of the pourable product through filling pipe 19 into tube 3.

It should be noted that operation of package forming unit 11 (and the interaction of operative assemblies 23 and counter-operative assemblies 24 with tube 3) determines a cyclic advancement speed of web 4 (in particular of the portion of web 4 downstream of tensioning device 32)

and/or tube 3 as shown in FIG. 6. In particular, the cyclic advancement speed profile of FIG. 6 is a repetition (according to a defined frequency) of the advancement speed of web 4 and/or tube 3 during the formation of one single package 2 as shown in FIG. 7.

In more detail, the advancement speed shown in FIG. 7 is determined by the manipulation of tube 3 by means of the respective operative assemblies 23 and counter-operative assemblies 24. As packaging forming unit 11 continuously forms packages 2 also the advancement speed of FIG. 7 continuously repeats according to the defined frequency (even though fluctuations and/or deviations may occur).

According to a preferred non-limiting embodiment, control unit 13 is configured to control main drive motor 34 such that the angular speed and/or the angular acceleration of main drive roller 33 is varied according to at least one pre-defined and/or pre-determined cyclic speed profile and/or acceleration profile; i.e. the speed profile and/or the acceleration profile is repetitive, in particular according to a pre-defined and/or pre-determined frequency, even more particular substantially in accordance with the production cycle of packages 2.

In particular, such a speed profile and/or such an acceleration profile and/or a plurality of speed profiles and/or a plurality of acceleration profiles is determined and/or defined as a function of the type and/or format of packages 2 and/or the advancement speed of web 4 and/or tube 3 and/or the advancement speeds of operative assemblies 23 and counter-operative assemblies 24 and/or the type of pourable product. Even more particular, each speed profile and/or each acceleration profile is determined and/or measured in a factory set-up (i.e. it is determined and/or measured prior to operation of packaging machine 1 and/or package forming unit 11 and/or filling device 11 and is coded in a respective speed profile of main drive roller 33).

It should be noted that the system comprising the tensioning device 32 and the portion of web 4 and/or tube 3 downstream of tensioning can be expressed according to the following formula: $J\ d\omega/dt=Cm+T*r$, with J being the moment of inertia of a group comprising at least main drive motor 34 and main drive roller 33, $\omega=(v(t))/r$ with v(t) being the time-dependent advancement speed of web 4 and/or tube 3 downstream of tensioning device 32 along advancement path P and as determined by package forming unit 11 and r being the radius of main drive roller 33, Cm being the motor torque and T being the tension of web 4 and/or tube 3 downstream of tensioning device 32 along advancement path P.

As described above, the advancement speed of web 4 and/or tube 3 is dependent on operation of package forming unit 11 and is thus not a variable controllable by tensioning device 32, thus it is possible to control the tension of web 4 and/or tube 3 by controlling the motor torque Cm of main drive motor 34 or in other words the angular velocity and/or angular acceleration transferred by main drive motor 34 to main drive roller 33. The motor torque can be expressed as $Cm=J\ d\omega/dt-T*r$. In the specific case that the tension T is to be kept (substantially) constant, the motor torque Cm is proportional to the rotational torque $J\ d\omega/dt$.

Preferentially but not necessarily, control unit 13 stores one or more speed profiles and/or acceleration profiles, which, in use, can be chosen for the control of tensioning device 32, in particular at least the respective main drive motor 34.

It should be noted that according to the present invention the acceleration profile(s) and/or the angular acceleration(s) comprise(s) positive and negative accelerations (deceleration).

Figure 8:
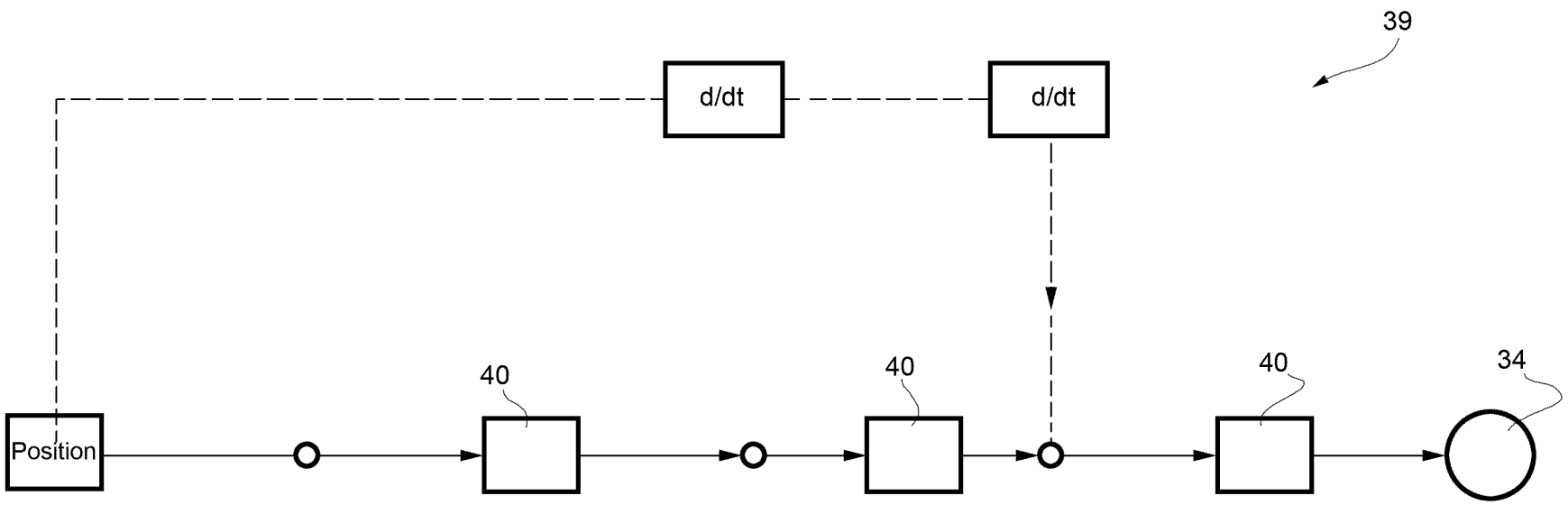
FIG. 8 shows a control scheme for the control of at least one drive motors present within the package machine of FIG. 1, with parts removed for clarity.

With particular reference to FIG. 8, control unit 13 comprises a portion 39 configured to control operation of main drive motor 34. In particular, portion 39 comprises one or more PID controllers 40 (proportional-integral-derivative controllers), each one configured to receive one respective control variable such as the angular position or the angular acceleration or the angular speed of main drive roller 33.

According to a preferred non-limiting embodiment, portion 39 receives information about the angular position, in particular the set angular position obtained from the speed profile, of main drive roller 33 and by the execution of a first derivation and a second derivation the angular position is transformed into an acceleration variable, which is fed into the respective PID controller 40. Preferentially but not necessarily, only the PID controller 40 receiving the angular acceleration information is active, while the other ones (if foreseen) are deactivate.

In addition or in alternative, for control purposes of main drive motor 34 the angular velocity and/or the angular acceleration is/are feed to portion 39.

According to a preferred non-limiting embodiment, control unit 13 is also configured to control the auxiliary drive motor and main drive motor 34 such that a free loop 38 of web 4 expands and/or advances, in use, between auxiliary drive roller 35 and main drive roller 33.

With respect to the present invention, the term free loop 38 indicates that the portion of web 4 expanding and/or advancing between auxiliary drive roller 35 and main drive roller 33 is not subjected to any tension and defines and/or forms free loop 38; i.e. the portion of web 4 defining and/or forming free loop 38 is exposed to no tensional forces and/or is free of any tensional forces. In other words, free loop 38 is a tension-free portion of web 4.

Preferentially but not necessarily, control unit 13 is configured to control the auxiliary drive motor such that an angular speed of auxiliary drive roller 35 is such to maintain and/or control, in particular the extension of, free loop 38 expanding and/or advancing between auxiliary drive roller 35 and main drive roller 33.

In particular, while, in use, the angular speed of auxiliary drive roller 35 substantially controls the extension of the respective free loop 38, the angular speed of main drive roller 33 substantially controls the tension of tube 3.

Preferentially but not necessarily, control unit 13 is configured to control auxiliary drive motor such that the angular speed of auxiliary drive roller 35 is substantially constant. In particular, substantially constant means that a possible variation of the angular speed of auxiliary drive roller 35 occurs at a lower rate than a variation of the angular speed of main drive roller 33.

According to a preferred non-limiting embodiment, control unit 13 is configured to control the auxiliary drive motor and, accordingly auxiliary drive roller 35, in dependence of the operation and/or control of main drive motor 34 and/or the angular speed of main drive roller 33.

According to a preferred non-limiting embodiment, tensioning device 32 also comprises at least one sensor element 41 configured to determine and/or measure, in use, the extension and/or level of the respective free loop 38 (i.e. the longitudinal length of the portion of web 4 expanding and/or extending between the respective auxiliary drive roller 35 and the respective main drive roller 33).

Preferentially but not necessarily, each sensor element 41 is configured to determine and/or measure the position of an apex 42 of the respective free loop 38 as a measure of the extension and/or level of the respective free loop 38.

According to a preferred non-limiting embodiment, tensioning device 32 further comprises an actuation group 46 configured to modify and/or control the relative orientation between the respective central axis E and the respective rotation axis B and/or to modify and/or control the relative orientation between the respective central axis C and the respective rotation axis A, in particular for (locally) controlling the orientation and/or the advancement direction of web 4.

Preferentially but not necessarily, actuation group 46 is coupled and/or connected to the respective auxiliary counter-roller 37 and/or main counter-roller 36 and is configured to control and/or vary the orientation of respectively the corresponding central axis E and the corresponding central axis C with respect to respectively the corresponding rotation axis B and the corresponding rotation axis A for locally controlling the advancement direction and/or the orientation and/or the alignment of web 4. In particular, locally controlling means that the advancement direction and/or the orientation and/or the alignment of web 4 is controlled immediately downstream of tensioning device 32 along advancement path P.

Figure 4:
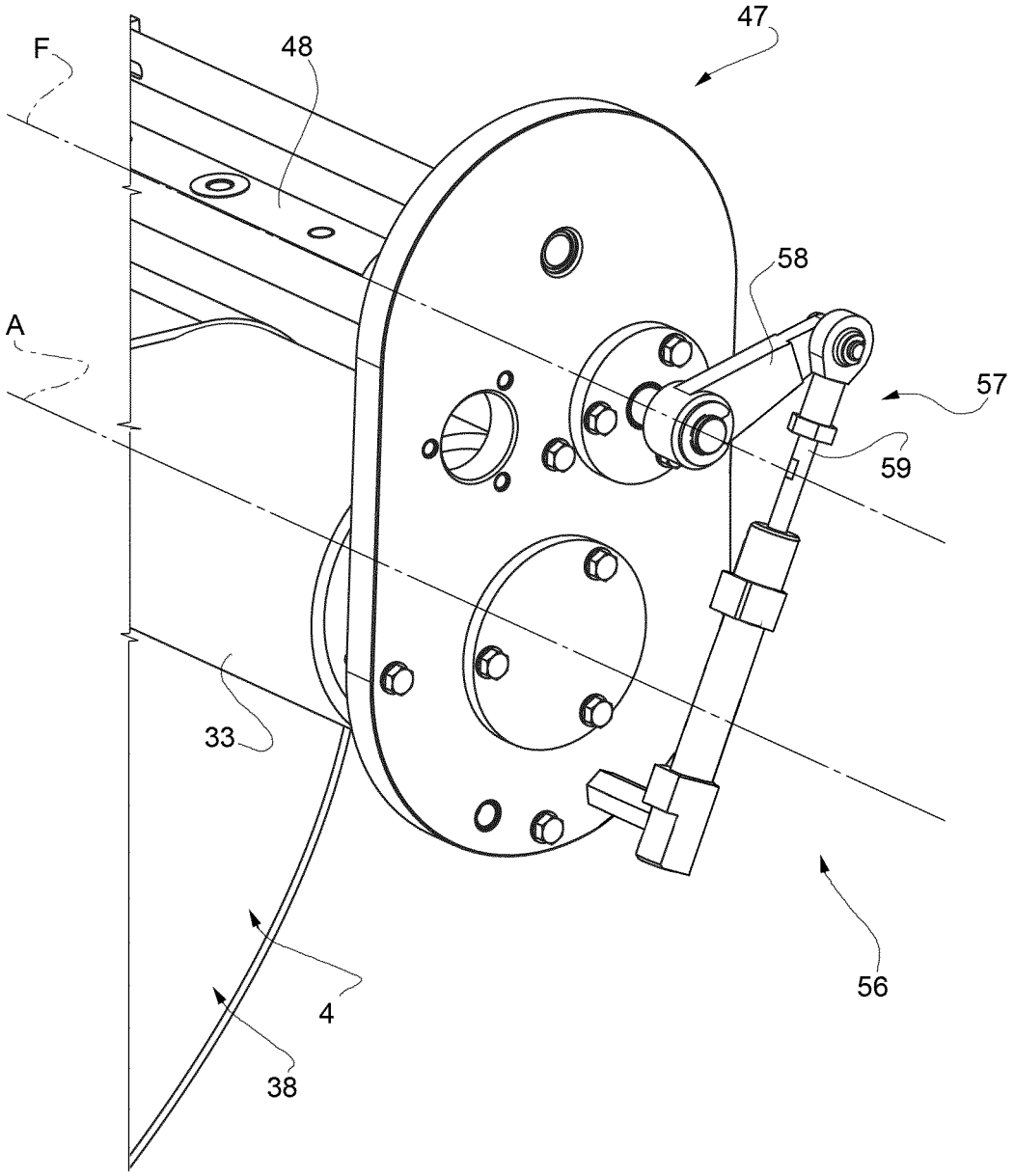
FIG. 4 is an enlarged perspective view of a portion of the detail of FIG. 3, with parts removed for clarity.

With particular reference to FIGS. 3 to 5, tensioning device 32 also comprises a support structure 47 carrying and/or supporting auxiliary drive roller 35, the auxiliary drive motor, main driver roller 33 and main drive motor 34.

Preferentially but not necessarily, support structure 47 also carries and/or supports auxiliary counter-roller 36 and/or main counter-roller 36 and/or actuation group 46.

According to a preferred non-limiting embodiment, support structure 47 comprises at least one support bar 48 (at least indirectly) carrying auxiliary counter-roller 37 or main counter-roller 36 and extending along a central axis F, in particular parallel to respectively rotation axis B and rotation axis A. Preferentially but not necessarily, support structure 47 comprises two support bars 48 one carrying auxiliary counter-roller 37 and the other one main counter-roller 36.

Preferentially but not necessarily, each support bar 48 is rotatable around the respective central axis F.

It should be noted that FIGS. 3 and 5, show the first portion of tensioning device 32; i.e. the support bar 48 shown (at least indirectly) carries main counter-roller 36. As the construction of the second portion of tensioning device 32 is similar to the construction of the first portion, in the following only the first portion is described. The difference between the first portion and the section portion is that the second portion comprises the auxiliary drive roller 35 and auxiliary counter-roller 37.

In particular, support structure 47 comprises at least one coupling element 49 pivoted around a pivot axis G on support bar 48 and being connected to and directly carrying the respective auxiliary counter-roller 37 or the respective main counter-roller 36.

According to a preferred non-limiting embodiment, actuation group 46 is configured to control the angular position of coupling element 49 around the respective pivot axis G for controlling central axis C with respect to main rotation axis A or central axis E with respect to auxiliary rotation axis B.

Preferentially but not necessarily, actuation group 46 comprises at least:

- a control bar 50 rotatable around a respective rotation axis I, in particular being parallel to the respective central axis F, and being configured to interact with the respective coupling element 49; and
- an electrical motor 51 configured to control the angular position of control bar 50 around rotation axis I for controlling the angular position of coupling element 49 around pivot axis G.

In particular, in use, upon a modification of the angular position of control bar 50 around the respective rotation axis I, coupling element 49 pivots around the pivot axis G, which again leads to a modification of the orientation of central axis C or central axis E.

Preferentially but not necessarily, each control bar 50 comprises an interaction portion 52, in particular in the form of a cam, configured to interact with an interaction member 53, in particular defining a cam follower, of the respective coupling element 49 for coupling the angular position of the respective control bar 50 to the angular position of the respective coupling element 49.

According to a preferred non-limiting embodiment, each tensioning device 32 also comprises at least one actuation assembly 56 configured to control the angular position of at least one respective support bar 48 around the respective central axis F for approaching or withdrawing main counter-roller 36 to or from main drive roller 33 or for approaching or withdrawing auxiliary counter-roller 37 to or from auxiliary drive roller 35.

According to the non-limiting embodiment shown, each actuation assembly 56 comprises at least one linear actuator 57 and at least one bar element 58 connected to linear actuator 57 and to the respective support bar 48.

Preferentially but not necessarily, each bar element 58 is transversal to the respective support bar 48 and to a piston 59 of the respective linear actuator 57.

According to an alternative embodiment not shown, each actuation assembly 57 could comprise at least one motor, e.g. a stepper motor, connected to the respective support bar 48 and configured to control the angular position of the respective support bar 48.

In use, packaging machine 1 forms packages 2 filled with the pourable product.

In more detail, the main production cycle comprises at least the following steps:

- advancing web 4 along advancement path P;
- folding web 4, in particular within isolation chamber 7, into tube 3 at tube forming station 6;
- advancing tube 3 along tube advancement path Q, in particular towards and at least partially through package forming unit 11; and
- controlling the tension of tube 3 by means of tensioning device 32.

Preferentially but not necessarily, the method also comprises the steps of:

- longitudinally sealing tube 3, in particular within isolation chamber 7; and/or
- filling tube 3 with the pourable product; and/or
- forming single packages 2 from tube 3 by forming tube 3, transversally sealing tube 3 between successive packages 2 and, in particular transversally cutting tube 3 between successive packages 2, for obtaining single packages 2 during advancement of tube 3 along tube advancement path Q; and/or
- sterilizing web 4 at sterilization station 8; and/or
- controlling and/or modifying the orientation of web 4 during which web 4 is, in particular selectively and locally, oriented and/or aligned.

According to a preferred non-limiting embodiment, during the step of advancing web 4, conveying device 5 advances web 4 along web advancement path P.

According to a preferred non-limiting embodiment, during the step of folding tube 3, tube forming and sealing device 9 gradually overlaps the opposite lateral edges of web 4 with one another so as to form the longitudinal seam portion.

According to a preferred non-limiting embodiment, during the step of longitudinally sealing tube 3, tube forming and sealing device 9 seals the longitudinal seam portion by directing heat onto the longitudinal seam portion.

According to a preferred non-limiting embodiment, during the step of advancing tube 3, conveying device 5 advances tube 3 (and any intermediates of tube 3), in particular through isolation chamber 7, along path Q into and partially through package forming unit 11.

According to a preferred non-limiting embodiment, during the step of filling tube 3, filling device 10 fills the pourable product into the longitudinally sealed tube 3. In particular, the pourable product is directed into tube 3 through filling pipe 19.

According to a preferred non-limiting embodiment, during the step of sterilizing web 4, at least the first face, in particular also the second face, of web 4 is/are sterilized.

Preferentially but not necessarily, during the step of sterilizing web 4 a sterilizing irradiation, in particular electromagnetic irradiation, even more particular electron beam irradiation, is directed onto at least the first face, preferentially also onto the second face, of web 4.

According to a preferred non-limiting embodiment, the step of sterilizing is executed prior to the step of folding.

According to a preferred non-limiting embodiment, during the step of forming single packages 2, package forming unit 11 forms and transversally seals tube 3 between successive packages 2 and, preferentially also transversally cuts tube 3 between successive packages 2.

Preferentially but not necessarily, during the step of forming single packages 2, operative assemblies 23 and counter-operative assemblies 24 advance along the respective conveying paths and cyclically form and transversally seal, in particular also transversally cut, tube 3 for obtaining packages 2. In particular, sealing elements 26 and counter-sealing elements 27 move from the respective rest position to the respective sealing position for transversally sealing tube 3 between successive packages 2 and half-shells 25 move from the respective rest positions to the respective working positions for forming tube 3.

According to a preferred non-limiting embodiment, during the step of controlling the tension, tensioning device 32 controls at least the tension of tube 3.

According to a preferred non-limiting embodiment, during the step of controlling the tension, main drive roller 33 rotates around main rotation axis A and the angular speed and/or the angular acceleration of main drive roller 33 cyclically varies. In particular, main drive motor 34 actuates the rotation of main drive roller 33, and even more particular controls the cyclical variation of the angular speed and/or angular acceleration of main drive roller 33.

According to a preferred non-limiting embodiment, during the step of controlling the tension, the angular speed of main drive roller 33 is cyclically varied as a function of the operation of package forming unit 11 and/or filling device 10 and/or the type and/or format of packages 2 and/or the package forming cycle.

Preferentially but not necessarily, the angular speed and/or angular acceleration of main drive roller 33 is varied according to respectively the pre-defined and/or pre-determined speed profile and acceleration profile.

According to a preferred non-limiting embodiment, during the step of controlling the tension, auxiliary drive roller 35 rotates around auxiliary rotation axis B and the main drive roller 33 rotates around main rotation axis A such that free loop 38 expands between and/or advances between auxiliary drive roller 35 and main drive roller 33.

Preferentially but not necessarily, during the step of controlling the tension, control unit 13 selectively and independently controls the auxiliary drive motor and main drive motor 34 for controlling rotation of respectively auxiliary drive roller 35 and main drive roller 33.

According to a preferred non-limiting embodiment, during the step of controlling the tension, the angular speed of auxiliary drive roller 35 is such to maintain free loop 38 between auxiliary drive roller 35 and main drive roller 33.

Preferentially but not necessarily, the angular speed of auxiliary drive roller 35 is substantially constant.

According to a preferred non-limiting embodiment, the step of controlling and/or modifying comprises the sub-step of controlling and/or modifying the relative orientation between at least central axis E and rotation axis B and/or the relative orientation between at least central axis C and rotation axis A.

Preferentially but not necessarily, during the sub-step of controlling and/or modifying, the orientation of at least central axis C is controlled and/or modified with respect to the respective rotation axis A for controlling an advancement direction and/or the orientation of web 4, in particular by means of actuation group 46.

Preferentially but not necessarily, during the sub-step of controlling and/or modifying, the angular position of the respective control bar 50 is controlled and/or modified by the respective electrical motor 51 for pivoting the respective coupling element 49 around the respective pivot axis G for controlling and/or modifying the orientation of main counter-roller 36 or auxiliary counter-roller 37.

According to a preferred non-limiting embodiment, the step of controlling and/or modifying comprises the sub-step of modifying the relative distance between main counter-roller 36 and main drive roller 33 or between auxiliary counter-roller 37 and auxiliary drive roller 35.

The advantages of packaging machine 1 according to the present invention will be clear from the foregoing description.

In particular, tensioning device 32 provides for an improved and more precise control of the tension of tube 3. This is achieved by tensioning device 32 having main drive roller 33 being driven according to a cyclic speed profile. Advantageously, this cyclic speed profile is synchronized with respect to the cyclic advancement speed of tube 3 as determined by the operation of package forming unit 11.

A further advantage resides in controlling main drive roller 33 according to a pre-defined speed profile. In this way, it is possible to control main drive roller 33 according to the cyclic forces acting on tube 3 during operation of package forming unit 11.

A further advantage resides in providing for auxiliary drive roller 35 and driving the auxiliary drive roller 35 such that a non-tensioned portion of web 4, namely free loop 38, advances, in use, between the auxiliary drive roller 35 and main drive roller 33.

An even further advantage resides in the possibility to control the alignment and/or orientation and/or the advancement direction of web 4 by controlling the relative orientation between at least auxiliary drive roller 35 and the respective auxiliary counter-roller 37 and/or at least main drive roller 33 and the respective main counter-roller 36.

Clearly, changes may be made to packaging machine 1 and the method as described herein without, however, departing from the scope of protection as defined in the accompanying claims.

The invention claimed is:

1. A packaging machine for producing sealed packages of a pourable product from a web of packaging material;

the packaging machine comprises:

a conveying device for advancing the web of packaging material along a web advancement path at least to a tube forming station at which the web of packaging material is formed, in use, into a tube and for advancing the tube along a tube advancement path;

a tube forming and sealing device configured to form the tube at the tube forming station and to longitudinally seal the tube;

a tensioning device arranged upstream of the tube forming station along the web advancement path and configured to control at least the tension of the tube; and a control unit configured to control operation of the packaging machine;

wherein the tensioning device comprises at least a main drive roller rotatable around a main rotation axis;

a main drive motor configured to actuate rotation of the main drive roller around the main rotation axis;

wherein the control unit is configured to control the main drive motor such that an angular speed and/or angular acceleration of the main drive roller is cyclically varied such to control the tension of the tube;

wherein the control unit is configured to control the main drive motor such that the angular speed and/or the angular acceleration of the main drive roller is varied according to respectively a pre-defined and/or pre-determined speed profile and/or acceleration profile.

2. Packaging machine according to claim 1, and further comprising a package forming unit adapted to at least form and transversally seal the tube during, in use, advancement of the tube along the tube advancement path;

wherein the control unit is configured to control the main drive motor such that the angular speed and/or angular acceleration of the main drive roller is varied and/or controlled as a function of the operation of the package forming unit and/or as a function of a package forming cycle and/or as a function of an advancement speed of the web of packaging material and/or of the tube.

3. Packaging machine according to claim 1, wherein the tensioning device also comprises a main counter-roller;

wherein the main counter-roller is arranged adjacent to the main drive roller;

wherein, in use, the web of packaging material is interposed and/or advances between the main counter-roller and the main drive roller;

wherein the tensioning device comprises an actuation group configured to control and/or modify the relative orientation between a central axis of the main counter-roller and the main rotation axis of the main drive roller.

4. Packaging machine according to claim 1, and further comprising:

an auxiliary drive roller rotatable around an auxiliary rotation axis;

an auxiliary drive motor configured to actuate rotation of the auxiliary drive roller around the auxiliary rotation axis; and wherein the control unit is configured to control the auxiliary drive motor and the main drive motor such that a free loop of the web of packaging material expands and/or advances, in use, between the auxiliary drive roller and the main drive roller.

5. Packaging machine according to claim 4, wherein the auxiliary drive roller is arranged upstream of the main drive roller along the web advancement path.

6. Packaging machine according to claim 4, wherein the control unit is configured to control the auxiliary drive motor such that an angular speed of the auxiliary drive roller is such to maintain, in use, the free loop.

7. Packaging machine according to claim 4, wherein the control unit is configured to control the auxiliary drive motor such that the angular speed of the auxiliary drive roller is substantially constant.

8. Packaging machine according to claim 1, and further comprising a sterilization apparatus configured to sterilize the web of packaging material at a sterilization station upstream of the tube forming station along the web advancement path;

wherein the tensioning device is interposed between the sterilization station and the tube forming station.

9. Method for producing sealed packages of a pourable product from a web of packaging material;

the method comprising:

advancing the web of packaging material along a web advancement path at least to a tube forming station;

forming the web of packaging material into a tube at the tube forming station;

advancing the tube along a tube advancement path;

controlling the tension of the tube by a tensioning device;

wherein the tensioning device is arranged upstream of the tube forming station along the web advancement path and has at least a main drive roller rotatable around a main rotation axis;

wherein during the controlling of the tension, the main drive roller rotates around the main rotation axis and an angular speed and/or an angular acceleration of the main drive roller is cyclically varied;

wherein the angular speed and/or the angular acceleration of the main drive roller is varied according to respectively a pre-defined and/or pre-determined speed profile and/or acceleration profile.

10. The method according to claim 9, and further comprising forming single packages from the tube by at least forming and transversally sealing the tube during advancement of the tube along the tube advancement path;

wherein during the controlling of the tension, the angular speed and/or the angular acceleration is varied as a function of the forming of single packages and/or as a function of an advancement speed of the web of packaging material along the web advancement path and/or of an advancement speed of the tube along the tube advancement path.

11. Method according to claim 9, wherein the tensioning device also comprises a main counter-roller arranged peripherally adjacent to the main drive roller;

wherein, during the advancing of the web of packaging material, the web of packaging material advances between the main counter-roller and the main drive roller;

wherein the method further comprises controlling and/or modifying the relative orientation between a central axis of the main counter-roller and the main rotation axis of the main drive roller.

12. Method according to claim 9, wherein the tensioning device further comprises an auxiliary drive roller rotatable around an auxiliary rotation axis and being arranged upstream of the main drive roller along the web advancement path;

wherein during the controlling of the tension, the auxiliary drive roller rotates around the auxiliary rotation axis and the main drive roller rotates around the main rotation axis such that a free loop of the web of packaging material expands and/or advances between the auxiliary drive roller and the main drive roller.

13. Method according to claim 12, wherein during the controlling of the tension, an angular speed of the auxiliary drive roller is such to maintain the free loop of the web of packaging material.

14. Method according to claim 12, wherein the angular speed of the auxiliary drive roller is substantially constant.

* * * * *